US005588344A

United States Patent [19]

Chun

[11] Patent Number: 5,588,344

[45] Date of Patent: Dec. 31, 1996

[54] ELECTRIC SERVO MOTOR PUNCH PRESS RAM DRIVE

[75] Inventor: Victor L. Chun, Charlotte, N.C.

[73] Assignee: Murata Machinery, Ltd., Kyoto, Japan

[21] Appl. No.: 261,052

[22] Filed: Jun. 13, 1994

[51] Int. Cl.[6] ..... B26D 5/14

[52] U.S. Cl. ..... 83/13; 83/76.6; 83/76.9; 83/628

[58] Field of Search ..... 83/13, 55, 76.6, 83/76.9, 628, 632

[56] References Cited

U.S. PATENT DOCUMENTS

| | | | |
|---|---|---|---|
| 2,182,544 | 12/1939 | Murrian et al. | 83/530 |
| 2,454,881 | 11/1948 | Michelman | 83/530 |
| 4,478,122 | 10/1984 | Hunter | 83/628 |
| 4,846,014 | 7/1989 | Shiga et al. | 83/628 |
| 4,979,410 | 12/1990 | Kusakabe | 83/578 |
| 5,115,735 | 5/1992 | Gloe et al. | 100/43 |
| 5,176,054 | 1/1993 | Capps | 83/13 |
| 5,279,197 | 1/1994 | Takeda et al. | 83/631 |

FOREIGN PATENT DOCUMENTS

| | | | |
|---|---|---|---|
| 551578A1 | 7/1993 | European Pat. Off. | 83/13 |

*Primary Examiner*—Eugenia Jones
*Assistant Examiner*—Charles Goodman
*Attorney, Agent, or Firm*—John R. Benefiel

[57] ABSTRACT

A punch press ram drive is described in which a reversible electrical servo motor is coupled to a crankshaft having an eccentric journal driving a pitman arm connected to the ram. The electrical servo motor is operated by program controls so as to either cause rotation or oscillation of the crankshaft to drive the ram through various programmed stroking modes, in which punch position, velocity, acceleration, varying over the course of a stroke may be programmed.

10 Claims, 3 Drawing Sheets

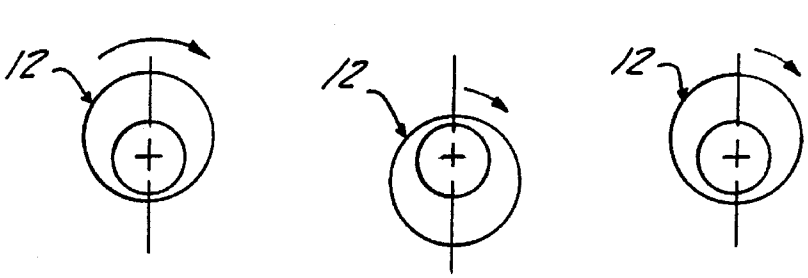
FIG-3A
FIG-3B
FIG-3C
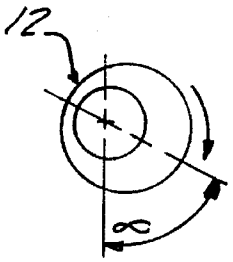
FIG-3D
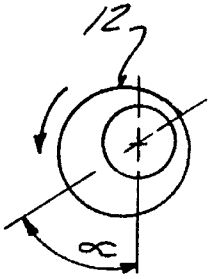
FIG-3E
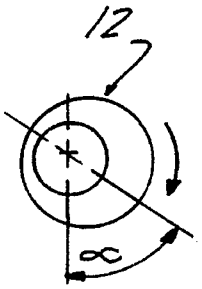
FIG-3F
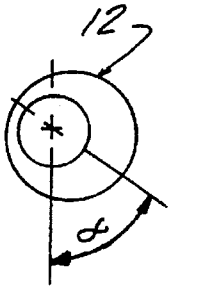
FIG-3G
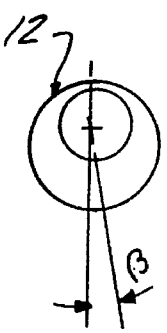
FIG-3H
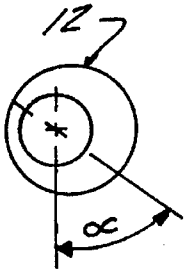
FIG-3I
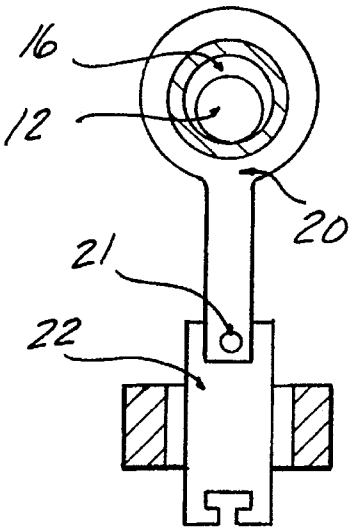
FIG-1A
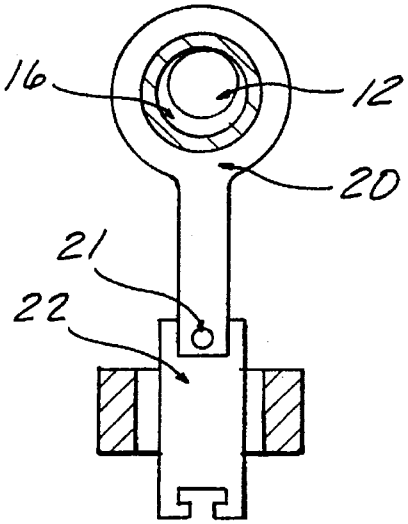
FIG-1B

ELECTRIC SERVO MOTOR PUNCH PRESS RAM DRIVE

BACKGROUND OF THE INVENTION

1. Field of the Invention

This invention concerns punch presses and more particularly a drive for a punch press ram which is coupled to punching or forming tools.

2. State of the Art

Punch presses for forming features or punching holes in sheet material workpieces involve a ram which is coupled to a forming or punching tool and drives the tool through a sheet material workpiece. Typically, the ram is driven by a crank mechanism, rotated by an AC electric motor. A flywheel may be interposed, with a clutch-brake controlling the connection of the flywheel to the crank mechanism, so that the stored energy in the rotating flywheel can be utilized to drive the ram.

A need for more sophisticated punching and forming motions has now been recognized as controlling the ram velocity to minimize punching noise, sometimes varying the velocity over the course of a punching stroke. As another example, the punch cycle time can be reduced by varying the speed of the ram over the punching cycle with a rapid ram advance and retraction combined with slow speed during actual punching.

Variable stroke control is also useful, as when forming louvers, and to minimize tooling set up.

In order to accomplish such sophisticated and flexible control over the ram motion, servo controlled hydraulic drives for rams have been developed, which allow a good deal of control over ram motion, such as variable speed and stroke punching.

See as examples of such hydraulic press ram drives, U.S. Pat. No. 4,823,658 issued on Apr. 25, 1989 for "Punch Presses", U.S. Pat. No. 4,208,935 issued on Jun. 24, 1980, for a "Control System for Hydraulic Press"; U.S. Pat. No. 5,031,431 issued on Jul. 16, 1991, for a "Method and Device for Controlling the Stroke of a Press Machine".

However, hydraulic equipment generally suffers from the disadvantages of increased cost and maintenance requirements, operates more slowly, and requires auxiliary cooling equipment.

Electrical servo motor ram drives have also been proposed, as described in U.S. Pat. No. 5,279,197 issued on Jan. 18, 1994, for a "Punch Press"; and U.S. Pat. No. 5,289,096 issued on Feb. 22, 1994, for a "Press Machine Stroke Operation Mechanism and Operation Control Method Therefor". Those patents describe a ball screw toggle mechanism for converting the rotary output of an electrical servo motor to a reciprocating ram motion.

The cost of a ball screw mechanism sufficiently sturdy to withstand the high level punching forces encountered in metal working would add substantially to the cost of a press.

The ball screw toggle mechanism described in those patents also requires a rapid motor reversal at bottom dead center, placing excessive demands on the mechanical and electrical components, and slowing the cycle time.

U.S. Pat. No. 5,279,197 also describes an electrical servo drive motor combined with a slider crank mechanism. However, in that combination, the servo motor is driven in a single direction, thus requiring the motion of a complete crank revolution to complete a punching stroke. The slider crank mechanism is also not suited to withstand the high forces required for metal working.

Accordingly, it is the object of the present invention to provide an electric servo motor punch ram drive mechanism which is capable of easily generating the high tonnage requirements for metal working, does not require rapid motor reversal when the punch is fully advanced, minimizes cycle time and improves flexibility in controlling ram velocities and stroke distances.

SUMMARY OF THE INVENTION

The present invention comprises the combination of a reversible electrical servo motor with an eccentric crankshaft ram drive. The reversible electrical servo motor drives the crankshaft eccentric through reduction gearing. A servo control allows various oscillating modes of the motor to carry out punching or forming cycles. The crankshaft may oscillate the eccentric through a programmed angular increment to carry out a predetermined punching stroke of a ram from a hover height defined by an initial angle of the crankshaft to a ram end position defined by the advanced angular position of the crankshaft. The reversing electric servo motor oscillates the crankshaft between these positions during execution of a partial stroke punching program.

During normal stroke punching, the motor oscillates the crankshaft between end positions on either side of bottom dead center to carry out punching from each end position, so that motor reversal does not occur until after completion of the retraction stroke.

The oscillating modes minimize cycle times by minimizing the motion required.

The motor can also rotate the crankshaft continously in a single direction for maximum stroke motion required for particular forming operations, or combined with synchronized table incremental feed to carry out nibbling very efficiently.

The reversible electrical servo motor can be programmed for any desired punch velocity acceleration, deceleration, positioning, dwell, etc. The punch velocity can be varied over the punch stroke, as can be done with the hydraulic actuators but without the operational disadvantages of hydraulic equipment.

DESCRIPTION OF THE DRAWINGS

FIG. 1A is a side elevational view of the crankshaft eccentric journal and coupled punch ram mechanism shown in FIG. 1, in the fully raised condition.

FIG. 1B is a side elevational view of the components shown in FIG. 1A shown in the full down condition.

FIGS. 3A–3I are diagrammatic representations of crankshaft angular positions through which the crankshaft eccentric journal is rotated or oscillated by the electrical servo motor drive.

DETAILED DESCRIPTION

In the following detailed description certain specific terminology will be employed for the sake of clarity and a particular embodiment described in accordance with the requirements of 35 USC 112, but it is to be understood that the same is not intended to be limiting and should not be so construed inasmuch as the invention is capable of taking many forms and variations within the scope of the appended claims.

Figure 1:
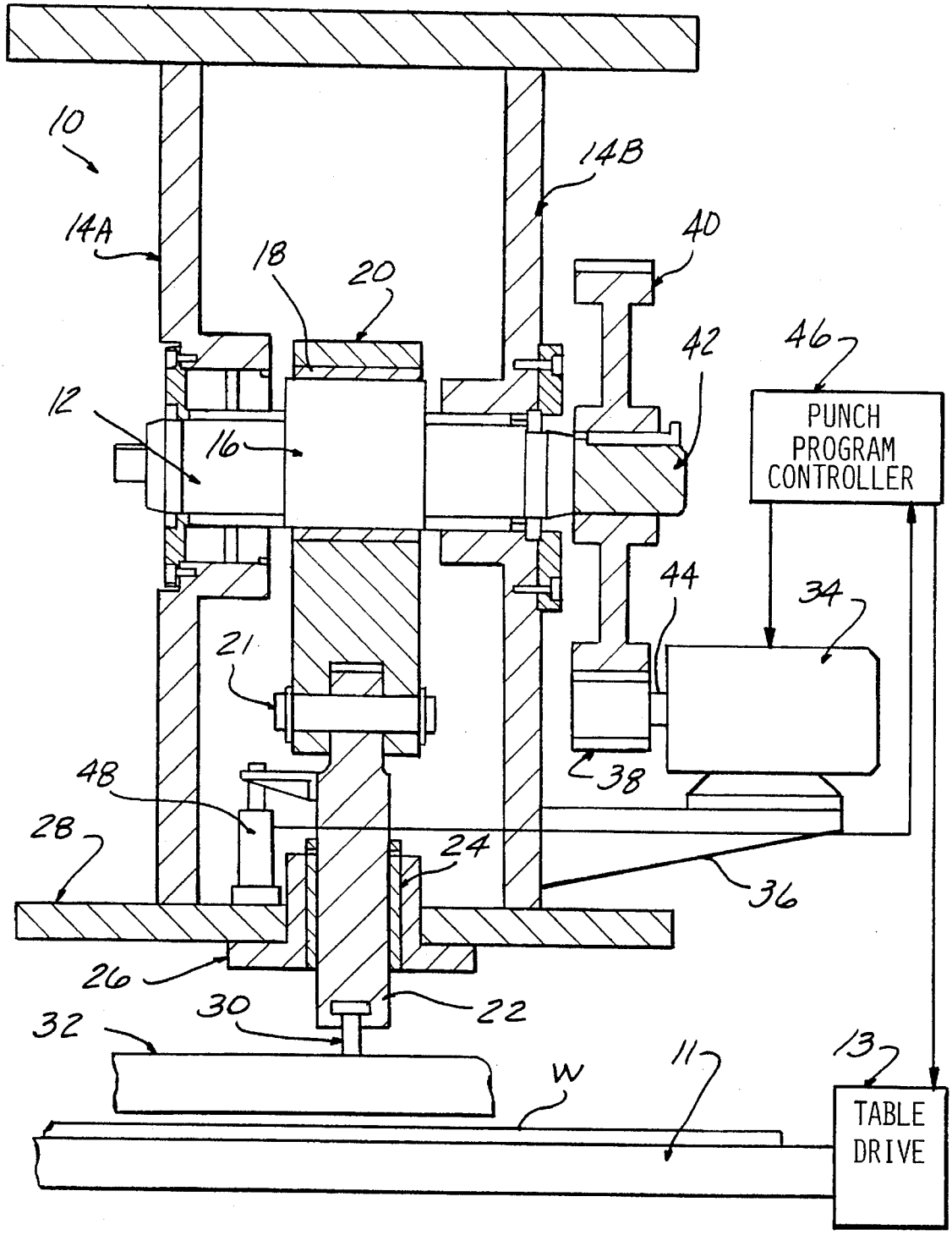
FIG. 1 is a fragmentary partially sectional view through a portion of a punch press incorporating an electrical servo motor eccentric journal crankshaft drive combination according to the present invention, using a linear transducer to generate ram position feedback signals.

Referring to the drawings, and particularly FIG. 1, a portion of a press frame 10 is shown which rotatably mounts a crankshaft 12 between housing plates 14A, 14B. The crankshaft 12 includes an eccentric journal 16 which receives a bushing 18 carried in a bore in the upper end of a pitman arm 20.

The lower end of the pitman arm 20 is connected with a fulcrum pin to a press ram 22 slidable in a guide bushing 24 fitting in a sleeve 26 mounted to lower plate 28 of the press frame 10.

The lower end of the press ram 22 is adapted to be coupled to the upper end of each of any of a series of punches in an upper turret 32 by means of a T-slot in the manner well known in the art.

A sheet material workpiece W held on a table 11 which has a positioning drive 13 which moves the table 11 to carry the workpiece to position a particular location on the workpiece W at the punching station. The workpiece W is punched (or formed) by downward stroking of the ram 22 forcing the punch or forming tool 30 through the workpiece W. A mating die in a lower turret (not shown) receives the punch tool 30 after passing through the workpiece W.

The stroking of the ram 22 occurs by rotation of the crankshaft 12, the ram 22 fully elevated when the eccentric journal 16 is rotated to its highest point (FIG. 1A) and fully depressed when the eccentric journal 16 is rotated to its lowest point at bottom dead center (FIG. 1B).

According to the concept of the present invention, the crankshaft 12 is driven by a reversible electrical servo motor 34 mounted on a pedestal 36 mounted alongside the side plate 14B. Reduction gearing 38, 40 drivingly connects a crankshaft extension 42 and the output shaft 44 of the electrical servo motor 34 so that rotation of the output shaft 44 of the servo motor 34 causes a lesser rotation of crankshaft 12.

Activation of the electrical servo motor 34 is controlled by the punch program controls 46 to cause a predetermined ram motion. Such program controls are generally well known and may take the form of a suitable programmed microprocessor, as described in U.S. Pat. No. 4,823,658 described above.

A linear transducer 48 is operatively connected to the ram 22 as shown, generating position feedback signals which are used in the controls 46 to achieve a desired ram position and motion.

Figure 2:
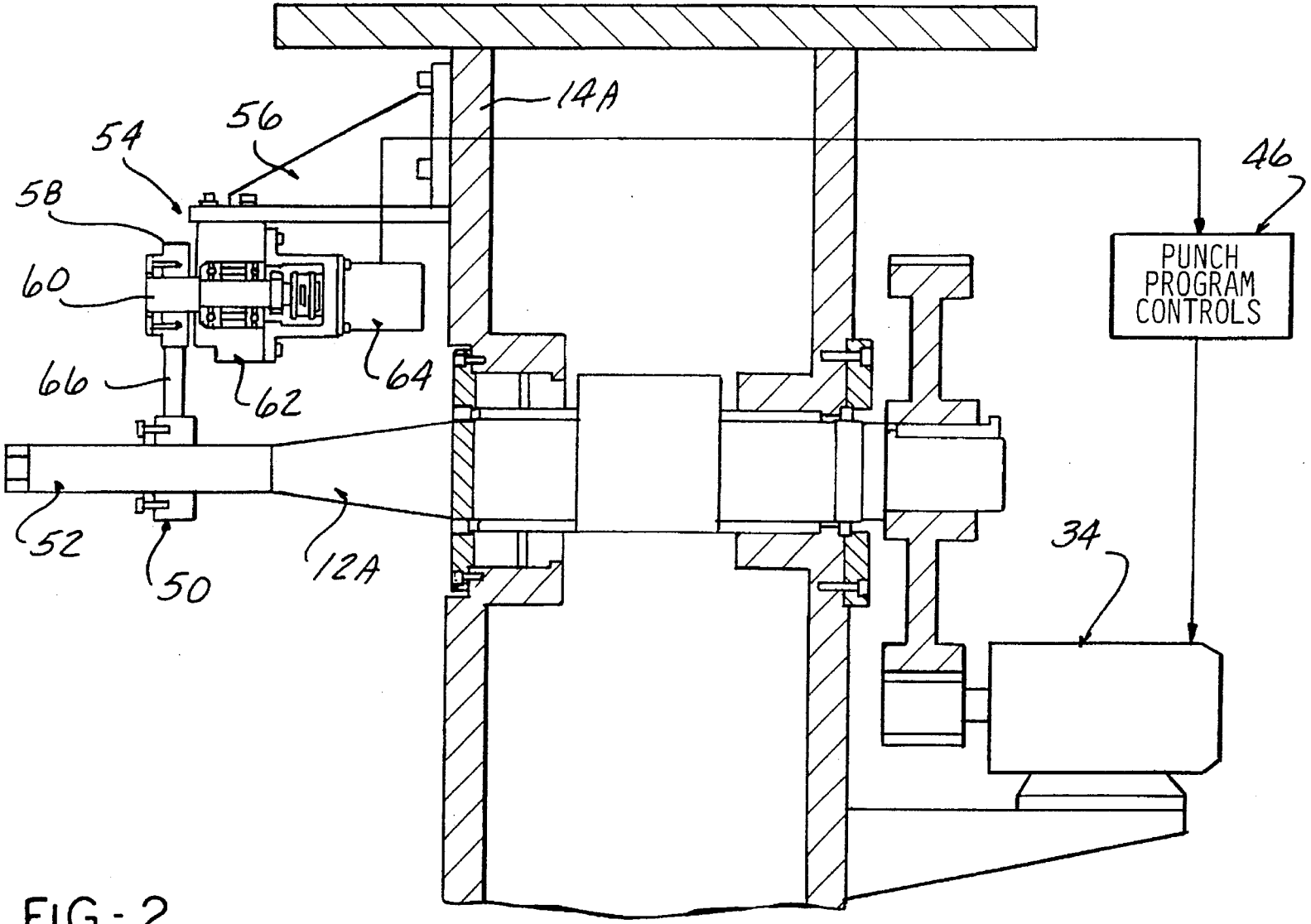
FIG. 2 is a fragmentary, partially sectional view of an alternate embodiment of the punch press shown in FIG. 1, with a rotary encoder used to generate ram position feedback signals.

FIG. 2 shows an alternate arrangement for generating ram position feedback signals. A pulley 50 is fixed to a second extension 52 of the crankshaft 12A. A rotary encoder assembly 54 is mounted to press frame side plate 14A on a bracket 56. A second pulley 58 is mounted to an encoder shaft 60 rotatably mounted in a bearing mount 62 supported by bracket 56.

A rotary encoder 64 generates feed back signals corresponding to the degree of rotation of the encoder shaft 60, in turn rotated by belt 66, so that these signals correspond to the angular position of the crankshaft 12A, which in turn corresponds to the position of the ram 22.

According to the concept of the invention, the electrical servo motor 34 is operated by the controls 46 so as to either rotate or oscillate the crankshaft 12 to carry out punching, forming, or nibbling.

In the full rotation mode as indicated in FIGS. 3A–3C, the crankshaft 12 rotates in one direction to carry the ram between fully raised to fully lowered positions.

The full stroke may be carried out in discrete rotations to carry out forming operations requiring maximum stroking, such as when forming tall louvers.

The motor 34 can be continuously rotated to conduct nibbling, by program controlling the table drive 13 to incrementally advance the table 11 in synchronism with the crankshaft rotation to very efficiently punch small portions progressively along a line of advance of the workpiece W.

FIG. 3A shows the crankshaft 12 rotated to an angular position corresponding to a fully raised position, in which the punch tool 30 is located at a maximum height above the workpiece W prior to a punching stroke.

A full punch stroke is accomplished by rotation of the crankshaft 12 to bottom dead center as shown in FIG. 3B, the crankshaft then rotated to the angular position to return the ram 22 to the fully raised height as shown in FIG. 3C.

The electrical servo motor 34 is preferably normally operated to oscillate the crankshaft 12 between angular positions on either side of bottom dead center corresponding to punching from the "hover height" to the fully down stroked position of the punch tool 30.

The "hover height" is the programmed clearance height to which the punch tool 30 is partially retracted during program controlled movement of the workpiece W between punching strokes. This ram height is below the fully retracted position of the ram 22, assumed prior to initiation of a program, in order to shorten the punching cycle time.

For a programmed stroke less than full stroke, the crankshaft 12 is rotated forward through the angle $\alpha$, and past bottom dead center by the angle $\alpha$, as shown in FIG. 3E driving the ram 22 through a complete punching stroke, less than a full ram stroke undergone.

This eliminates the need for reversing the servo motor 34 at bottom dead center, and allows a gradual stop before executing the next cycle.

The crankshaft 12 is then oscillated by being rotated reversely to the angular position $\alpha$ on the other side of bottom dead center (bdc) as shown in FIG. 3F.

FIGS. 3G–3I show a program motion where a full down stroke is not executed. The servo motor 34 is oscillated between a retracted position $\alpha$ degrees before dead center to an advanced position $\beta$ degrees before dead center.

In both oscillating modes, crankshaft rotation necessary to carry out the stroke is minimized to save cycle time. In the normal mode, rapid motor reversal is avoided.

The electrical servo motor 34 can execute programmed accelerations, decelerations, dwell periods, rapid approach, slow punch, fast strip, etc. as desired by the programmer. Thus, the sophistication allowed by the hydraulic actuators is achieved without being burdened with the disadvantages of hydraulic equipment as described above.

I claim:

1. A punch press comprising:

a punch press frame;

a punch ram slidably mounted on said punch frame and adapted to be coupled to a punch tool for carrying out punching operations;

a crankshaft rotatably mounted on said press frame, said crankshaft having an eccentric journal;

a pitman arm having an upper end rotatably received over said crankshaft eccentric journal, and a lower end coupled to said ram, stroking of said ram caused by rotation of said crankshaft;

a reversible electrical servo motor having an output shaft and means drivingly connecting said servo motor output shaft and said crankshaft to enable rotation of said crankshaft to a controlled angular position;

position feedback signal generator means, generating feedback signals corresponding to the position of said ram;

punch program control means receiving said feedback signals and causing said reversible electrical servo motor to rotate said crankshaft through a programmed sequence of positions corresponding to a punching program to selectively either rotate said crankshaft through full revolutions or to oscillate said crankshaft between rotated positions less than a full revolution apart.

2. A punch press according to claim 1, wherein said punch program control means causes said reversible electrical servo motor to oscillate said crankshaft to cause said ram to move between a partially retracted to an extended position corresponding respectively to a hover height punch tool position and an end punch penetrated position.

3. The punch press according to claim 2 wherein said program control means causes said servo motor to oscillate said crankshaft between angular positions on either side of bottom dead center.

4. A punch press according to claim 2, wherein said ram is only partially descended during said oscillation of said crankshaft whereby a programmed punch stroke is executed.

5. A punch press according to claim 1, wherein said means drivingly connecting said servo motor output shaft and said crankshaft comprises means causing a rate of crankshaft rotation slower than said servo motor output shaft rotation.

6. A punch press according to claim 1, wherein said feedback signal generating means comprises a linear position transducer operatively coupled to said ram.

7. A punch press according to claim 1, wherein said feedback signal generating means comprises a rotary encoder rotatably coupled to said crankshaft.

8. A method of driving a ram of a punch press through a programmed punching operation comprising the steps of:

coupling a reversible electrical servo motor to a crankshaft having an eccentric journal, the journal receiving an upper end of a pitman arm which has a lower end coupled to said ram;

rotating the electrical servo motor under program control to cause the crankshaft to oscillate through a range of rotation corresponding to a ram punching stroke; wherein said crankshaft is oscillated through a range of movement through bottom dead center from a position partially rotated before bottom dead center to a position partially rotated past bottom dead center, corresponding to a punching stroke between a partially retracted hover height and a fully extended ram position.

9. The method according to claim 8 wherein said electrical servo motor is controlled using ram position feedback signals to carry out a program of controlled ram movements.

10. The method according to claim 9 wherein, said electrical servo motor is controlled to carry out controlled accelerations of said ram.

* * * * *